US009522533B1

(12) United States Patent
Seto et al.

(10) Patent No.: US 9,522,533 B1
(45) Date of Patent: Dec. 20, 2016

(54) DROPLET DRIVING CONTROL DEVICE AND IMAGE FORMING APPARATUS

(71) Applicant: FUJI XEROX CO., LTD., Tokyo (JP)

(72) Inventors: Shinji Seto, Kanagawa (JP); Hirotake Sasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/005,245

(22) Filed: Jan. 25, 2016

(30) Foreign Application Priority Data

Jul. 2, 2015 (JP) ..... 2015-133318

(51) Int. Cl.
*B41J 29/393* (2006.01)
*B41J 2/045* (2006.01)

(52) U.S. Cl.
CPC ..... *B41J 2/04588* (2013.01); *B41J 2/04573* (2013.01); *B41J 2/04586* (2013.01)

(58) Field of Classification Search
CPC ... B41J 29/393; B41J 11/0095; B41J 2/17566; B41J 2002/17569; B41J 2002/14354; B41J 2/14153; B41J 2/04508
See application file for complete search history.

(56) References Cited

U.S. PATENT DOCUMENTS 8,911,064 B2 * 12/2014 Link ..... B41J 2/09 347/74
9,102,142 B2 * 8/2015 Gracia Verdugo ..... B41J 2/2142
9,132,629 B2 * 9/2015 Ward ..... B41J 2/0451 347/14

FOREIGN PATENT DOCUMENTS

JP 7-323550 12/1995
JP 2006-088712 4/2006
JP 2007-022095 2/2007

OTHER PUBLICATIONS

Abstract and machine translation of JP 2006-088712.
Abstract and machine translation of JP 2007-022095.
Abstract and machine translation of JP 7-323550.

* cited by examiner

*Primary Examiner* — Lamson Nguyen
(74) *Attorney, Agent, or Firm* — Fildes & Outland, P.C.

(57) ABSTRACT

A droplet driving control device includes: a droplet ejection control unit which ejects droplets at requested droplet ejection periods; and an adjustment unit which adjusts control of the droplet ejection control unit using at least continuous two of the droplet ejection periods as one set based on an error of droplet speed with respect to a proper value thereof, so that droplets can be ejected at different droplet ejection periods within a range of the one set, and an average value of the droplet ejection periods within the range of the one set for ejecting the droplets can be equal to each of the requested droplet ejection periods.

19 Claims, 11 Drawing Sheets

(CONT.)

(FIG. 7 CONTINUED)
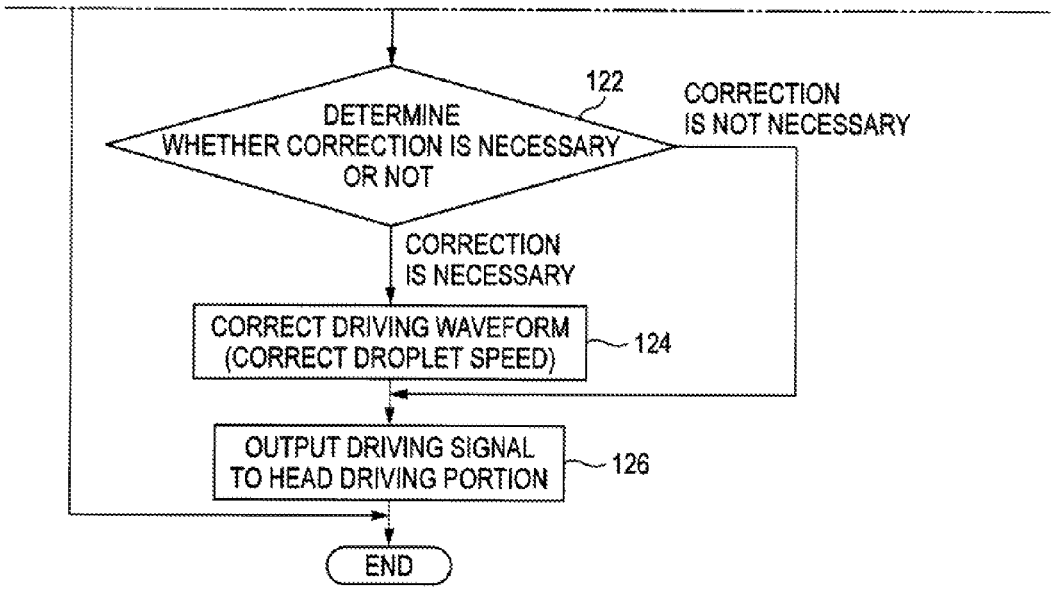

DROPLET DRIVING CONTROL DEVICE AND IMAGE FORMING APPARATUS

CROSS-REFERENCE TO RELATED APPLICATIONS

This application is based on and claims priority under 35 USC 119 from Japanese Patent Application No. 2015-133318 flied on Jul. 2, 2015.

Background

1. Technical Field

The present invention relates to a droplet driving control device and an image forming apparatus.

2. Related Art

In an apparatus which ejects droplets of ink etc. to form an image, such as an inkjet continuous feed printer, a driving frequency for controlling timing of droplet ejection is set in accordance with image formation speed.

SUMMARY

According to an aspect of the invention, there is provided a droplet driving control device comprising: a droplet ejection control unit which ejects droplets at requested droplet ejection periods; and an adjustment unit which adjusts control of the droplet ejection control unit using at least continuous two of the droplet election periods as one set based on an error of droplet speed with respect to a proper value thereof, so that droplets can be ejected at different droplet ejection periods within a range of the one set, and an average value of the droplet ejection periods within the range of the one set for ejecting the droplets can be equal to each of the requested droplet election periods.

BRIEF DESCRIPTION OF THE DRAWINGS

Exemplary embodiments of the present invention will be described in detail based or the following figures, wherein.

REFERENCE SIGNS LIST

Figure 1:
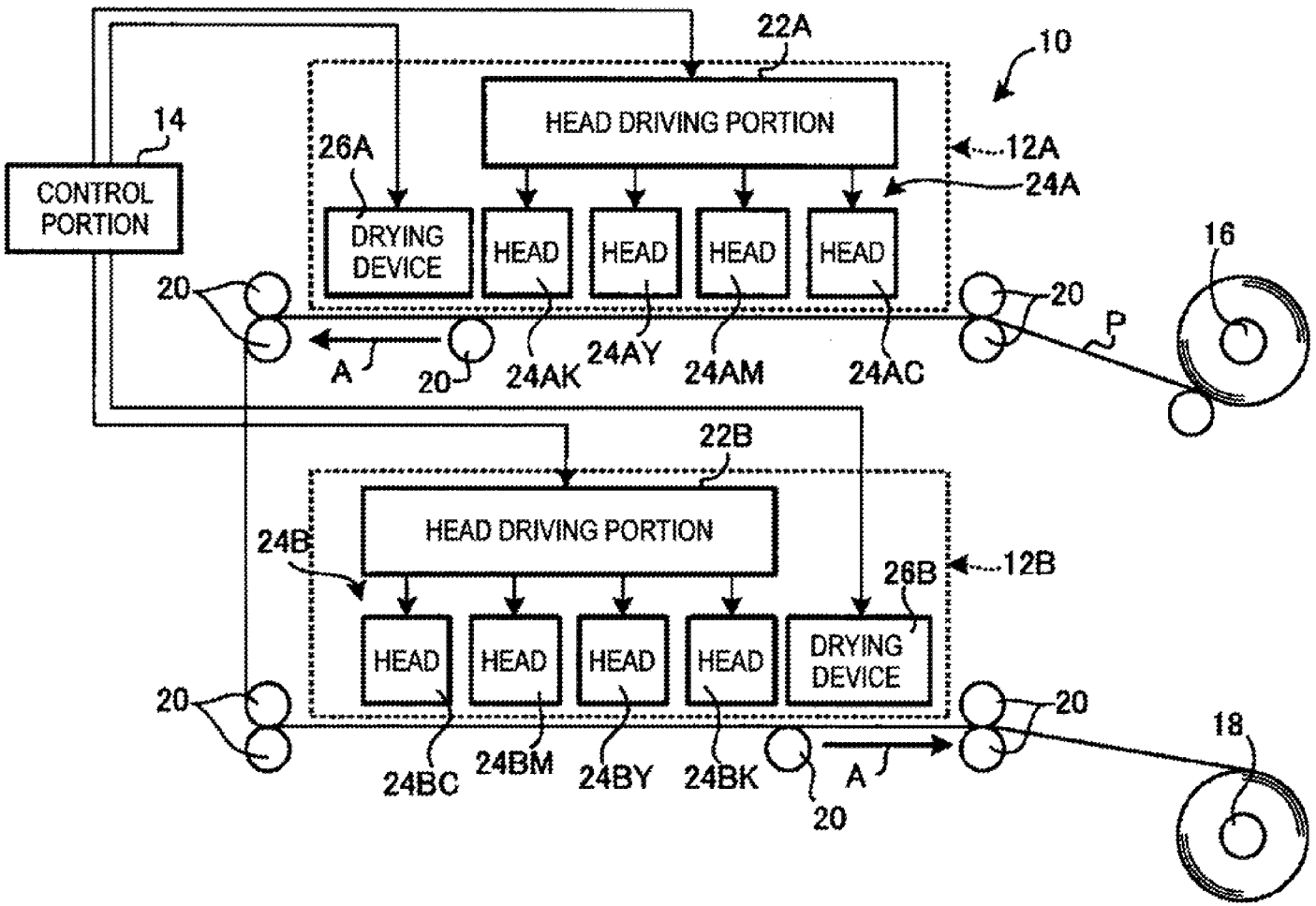
FIG. 1 is a schematic configuration diagram showing an example of a main configuration portion of a droplet ejection type recording apparatus according to an exemplary embodiment of the invention.

10 droplet ejection type recording apparatus
12 (12A, 12B) image forming portion
14 control portion
16 paper supplying roll
18 discharging roll
20 feeding roller
22 (22A, 22B) head driving portion
24 (24A, 24B) head
26 (26A, 26B) drying device
24AC, 24AM, 24AY, 24AK head
24BC, 24BM, 24BY, 24BK head
30 droplet ejecting member
32 nozzle
34 pressure chamber
36 supply port
38 common passage
40 diaphragm
42 piezoelectric element
40A common electrode
42A individual electrode
50 CPU
52 RAM
54 ROM
56 I/O
58 bus
60 microcomputer
62 user interface (UI)
64 hard disk (HDD)
66 communication I/F
70 image formation instruction information accepting portion
72 image information importing portion
74 designated image formation speed information extracting portion
76 image formation pattern generating portion
78 droplet ejection period calculating portion
80 determination portion
82 image formation speed setting range storage portion
84 droplet ejection period to droplet speed characteristic table storage portion
86 ejection control selecting portion
88 adjusted ejection period generating portion
90 steady ejection period generating portion
92 driving waveform correcting portion
94 driving instruction portion

DETAILED DESCRIPTION (Outline of Apparatus)

FIG. 1 is a schematic configuration diagram showing a main configuration portion of a droplet ejection type recording apparatus 10 as an example of an image forming apparatus according to an exemplary embodiment of the invention.

For example, the droplet ejection type recording apparatus 10 is provided with two image forming portions 12A and 12B, a control portion 14, a paper supplying roll 16, a discharging roll 18, and a plurality of feeding rollers 20. The two image forming portions 12A and 12B can form images on opposite surfaces of a paper sheet P in one feeding.

In addition, the image forming portion 12A is provided with a head driving portion 22A as an example of a droplet ejection control unit. Further, the image forming portion 12A includes heads 24A and a drying device 26A.

Similarly, the image forming portion 12B is provided with a head driving portion 22B as an example of a droplet election control unit. Further, the image forming portion 12B includes heads 24B and a drying device 26B.

Incidentally, there is a case where indication of a suffix "A" and a suffix "B" at the ends of signs may be omitted below when it is not necessary to distinguish between the image forming portion 12A and the image forming portion 12B and between common members included in the image forming portion 12A and the image forming portion 12B.

The control portion 14 drives a not-shown paper feeding motor to control rotation of the feeding rollers 20 which are, for example, connected to the paper feeding motor through a mechanism of gears etc.

A long paper sheet P is wound as a recording medium around the paper supplying roll 16. The paper sheet P is fed in a direction of an arrow A (paper feeding direction) in FIG. 1 in accordance with rotation of the feeding rollers 20.

Upon acceptance of image information, the control portion 14 controls the image forming portion 12A based on color information for each pixel of an image contained in the image information. Thus, the image corresponding to the image information is formed on one image formation surface of the paper sheet P.

Specifically, the control portion 14 controls the head driving portion 22A. The head driving portion 22A drives the heads 24A connected to the head driving portion 22A in accordance with droplet ejection timings instructed from the control portion 14, so as to eject droplets as an example of droplets from the heads 24A and form the image corresponding to the image information on the one image formation surface of the fed paper sheet P.

Incidentally, the color information for each pixel of the image included in the image information includes information expressing the color of the pixel uniquely. In this exemplary embodiment, assume that the color information for each pixel of the image is represented by respective concentrations of yellow (Y), magenta (M), cyan (C), or black (K). Another representation method for expressing the colors of the image uniquely may be used.

The heads 24A include four heads 24AC, 24AM, 24AY and 24AK corresponding to the four colors, i.e. the Y color, the M color, the C color and the K color, respectively. Droplets of the corresponding colors are ejected from the respective heads 24A.

The control portion 14 controls the drying device 26A to dry the droplets of the image formed on the paper sheet P to thereby fix the image to the paper sheet P.

Then, the paper sheet P is fed to a position opposing to the image forming portion 12B in accordance with rotation of the feeding rollers 20. On this occasion, the paper sheet P is turned inside out and fed so that the other image formation surface different from the image formation surface on which the image has been formed by the image forming portion 12A can face the image forming portion 12B.

The control portion 14 also executes, on the image forming portion 12B, similar control to the aforementioned control on the image forming portion 12A. Thus, an image corresponding to the image information can be formed on the other image formation surface of the paper sheet P.

The heads 24B include four heads 24BC, 24BM, 24BY, and 24BK corresponding to the four colors, i.e. the Y color, the M color, the C color and the K color, respectively. Droplets of the corresponding colors are ejected from the respective heads 24B.

The control portion 14 controls the drying device 26B to dry the droplets of the image formed on the paper sheet P to thereby fix the image to the paper sheet P.

Then, the paper sheet P is fed to the discharging roll 18 and wound around the discharging roll 18 in accordance with rotation of the feeding rollers 20.

Incidentally, the configuration of the apparatus for forming images on front and back surfaces of a paper sheet P in one feeding starting at the paper supplying roll 16 and ending at the discharging roll 18 has been described as the droplet ejection type recording apparatus 10 according to this exemplary embodiment. It is however a matter of course that the droplet ejection type recording apparatus 10 may be a droplet ejection type recording apparatus for forming an image on a single surface.

In addition, ink as an example of a droplet includes water-based ink, oil-based ink serving as ink containing a solvent which can be evaporated, ultraviolet-curable type ink, etc. However, assume that water-based ink is used in the this exemplary embodiment. When it is mentioned as "ink" or "droplet" simply in this exemplary embodiment, it may imply "water-based ink" or "water-based ink droplet".

(Head 24)

Figure 2A:
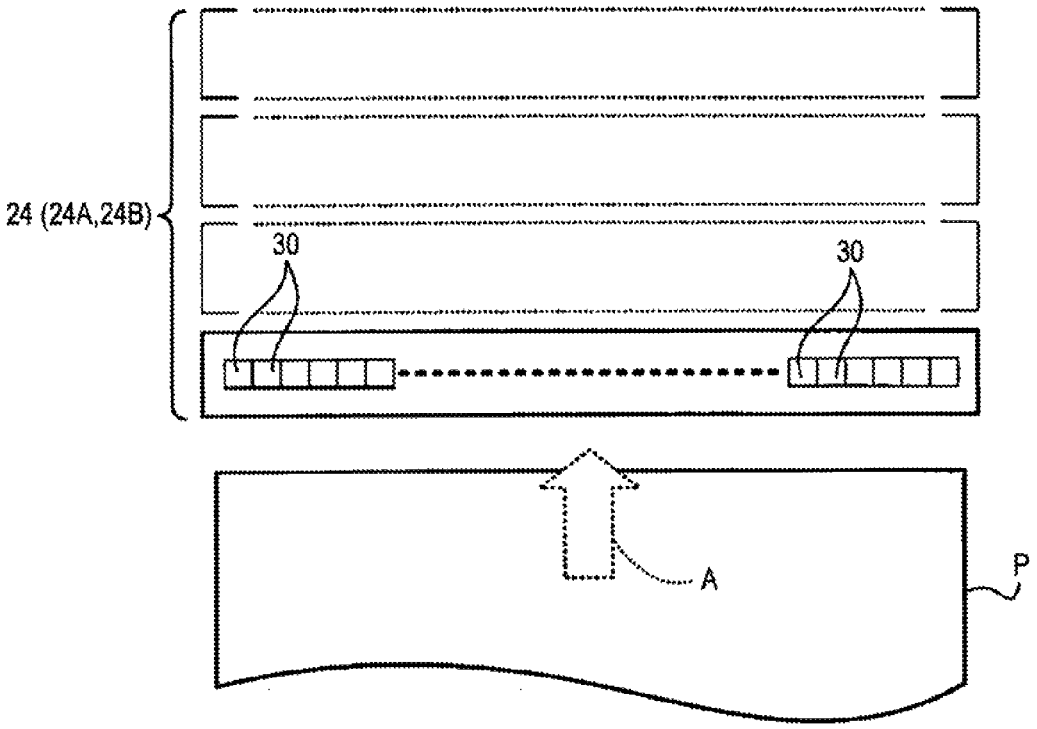
FIGS. 2A and 2B are plan views showing a head and a sectional view showing an internal structure of each droplet ejecting element in the head according to the exemplary embodiment.

As shown in FIG. 2A, each of the heads 24 applied to the image forming portion 12 has droplet ejecting members 30 which are arranged in a longitudinal direction of the head. Incidentally, the longitudinal direction of the head is a direction intersecting with a feeding direction of the paper sheet P (a direction of an arrow A in FIG. 2A), and may be referred to as main scanning direction. In addition, the feeding direction of the paper sheet P (the direction of the arrow A in FIG. 2A) may be referred to as sub-scanning direction.

The layout of the droplet ejecting members 30 is not limited to a single array line in the main scanning direction. In some dot pitch (resolution), a plurality of array lines of droplet ejecting members 30 provided in the sub-scanning direction may be arrayed two-dimensionally in accordance with predetermined rules so that ejection timing in each array line can be controlled in accordance with the array line pitch and feeding speed of the paper sheet P.

Figure 2B:
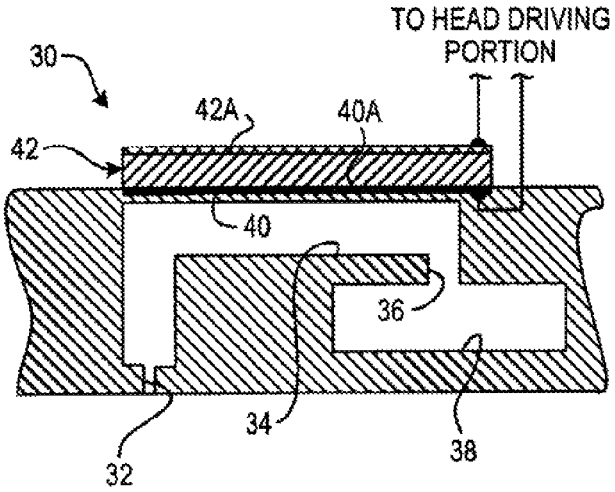

As shown in FIG. 2B, the droplet ejecting members 30 are provided with nozzles 32 and pressure chambers 34 corresponding to the nozzles 32 respectively.

A supply port 36 is provided in each of the pressure chambers 34. The pressure chambers 34 are connected to a common passage (common passage 38) through the supply ports 36.

The common passage 38 has a role of receiving supply of ink from an ink supply tank (not shown) as an ink supply source and distributing the received supply of the ink to the respective pressure chambers 34.

A diaphragm 40 is attached to an upper surface of a ceiling portion of the pressure chamber 34 in each droplet ejecting member 30. In addition, a piezoelectric element 42 is attached to the upper surface of the ceiling portion of the pressure chamber. The diaphragm 40 is provided with a common electrode 40A. The piezoelectric element 42 is provided with an individual electrode 42A. When a voltage is selectively applied between the individual electrode 42A of the piezoelectric element 42 and the common electrode 40A, the selected piezoelectric element 42 is deformed so that a droplet can be ejected from the nozzle 32 and new ink can be supplied from the common passage 38 to the pressure chamber 34.

Each of the head driving portions 22 (22A and 22B) is controlled by the control portion 14 (see FIG. 1) based on the image information to generate a driving signal for applying a voltage to each of the individual electrodes 42A of the piezoelectric elements 42 independently.

To eject each droplet, image formation speed (droplet ejection period) which can guarantee designated image quality can be set in a predetermined setting range (particularly with a maximum image formation speed Vmax as an upper limit).

Incidentally, a lower limit of the setting range is not particularly limited. Theoretically, it will go well as long as the lower limit of the setting range is a positive number (a number larger than 0). In addition, the setting may include one or both of paper feeding speed and the resolution in addition to the image formation speed.

When there is a change in the setting of the image formation speed, frequency control (droplet ejection period control) is executed on each of the heads 24 by the head driving portion 22.

Figure 3:
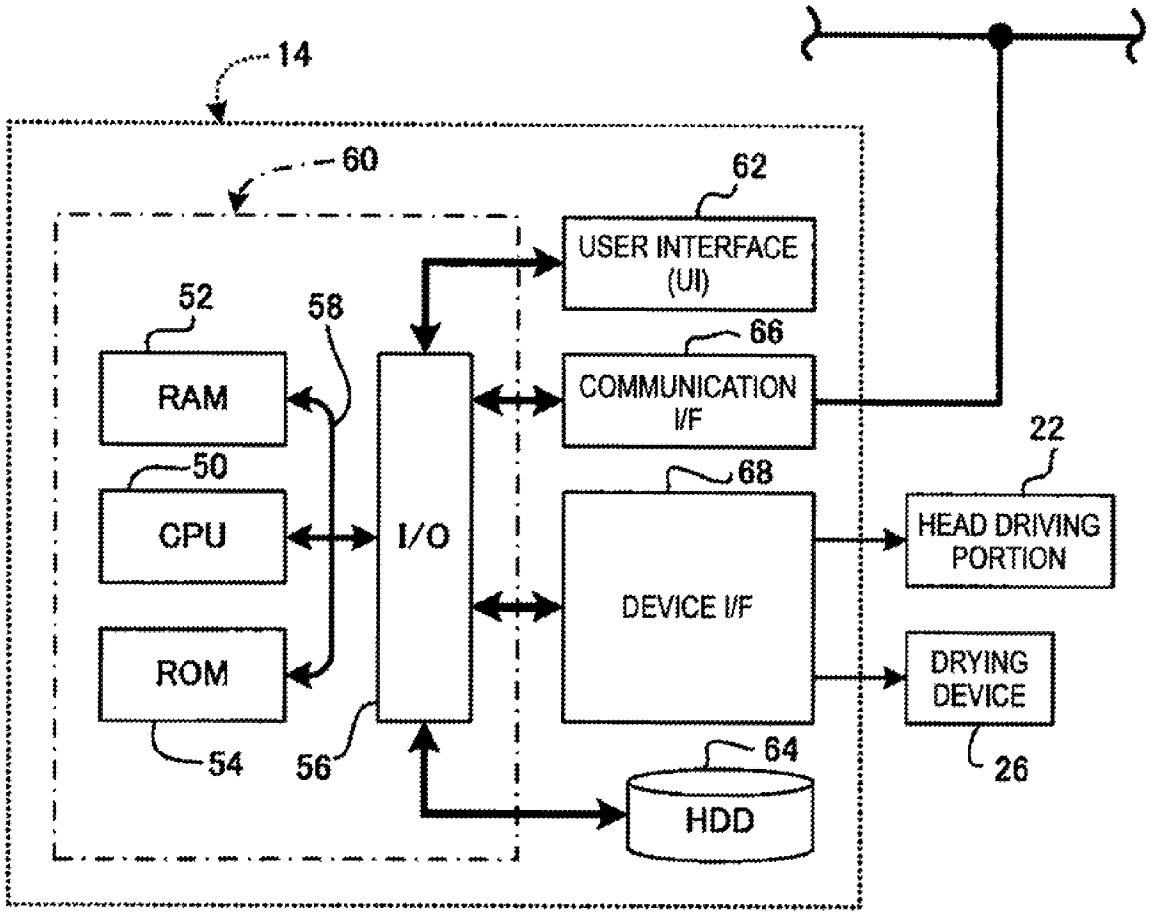
FIG. 3 is a block diagram of a control portion according to the exemplary embodiment.

As shown in FIG. 3, the control portion 14 is equipped with a microcomputer 60. The microcomputer 60 is provided with a CPU 50, an RAM 52, an ROM 54, an I/O 56, and a bus 58. The bus 58 such as a data bus or a control bus connects the CPU 50, the RAM 52, the ROM 54 and the I/O 56 to each other.

A user interface (UI) 62, a hard disk (HDD) 64, and a communication I/F 66 which is performed by radio (or cable) are connected to the I/O 56. In addition, a device I/F 68 which serves as a connection terminal to any of external devices (the head driving portions 22 and the drying devices 26 in this exemplary embodiment) is connected to the I/O 56.

Here, in a specific high-frequency band exceeding the upper limit (Vmax) which can guarantee the image quality, droplet speed or a droplet amount fluctuates in accordance with residual pressure vibration (see a frequency band fm in FIG. 5A and a period range width Tm in FIG. 5B) of each piezoelectric element 42. Therefore, the image formation speed is limited to the setting range (upper limit) which is not affected by the pressure vibration.

In other words, at an image formation speed exceeding a frequency corresponding to the maximum image formation speed Vmax serving as the upper limit, a landing position of the droplet on the paper sheet P or the size of the landed droplet varies to thereby lower the image quality.

On the other hand, in this exemplary embodiment, control for suppressing the fluctuation in the droplet speed or the droplet amount is constructed in the frequency band in which the droplet speed or the ink droplet amount fluctuates (the specific high-frequency band exceeding the frequency corresponding to the maximum speed Vmax).

That is, in this exemplary embodiment, period adjustment control is executed in the following control procedures in the control portion 14.

Figure 5A:
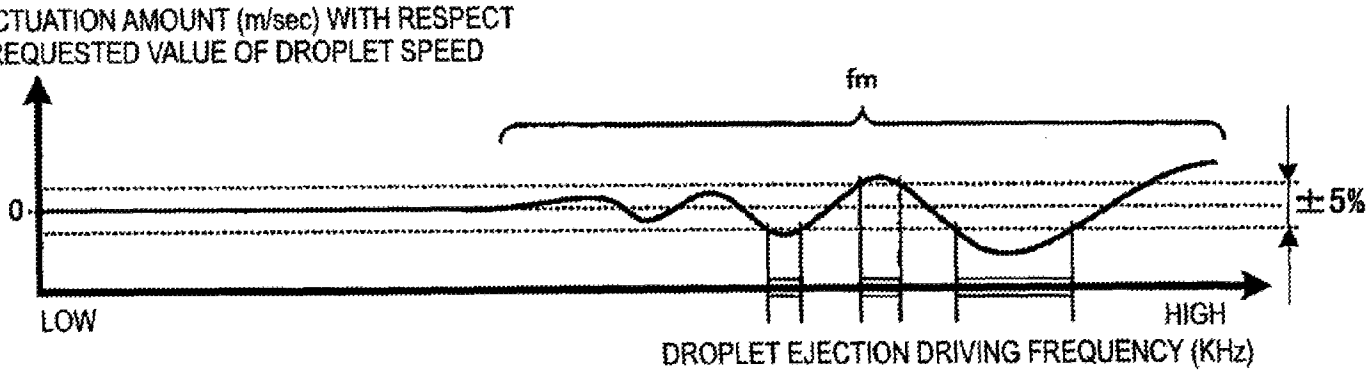
FIGS. 5A and 5B are a droplet ejection driving frequency to droplet speed fluctuation amount characteristic graph and a droplet ejection period to droplet speed fluctuation amount characteristic graph respectively.
Figure 5B:
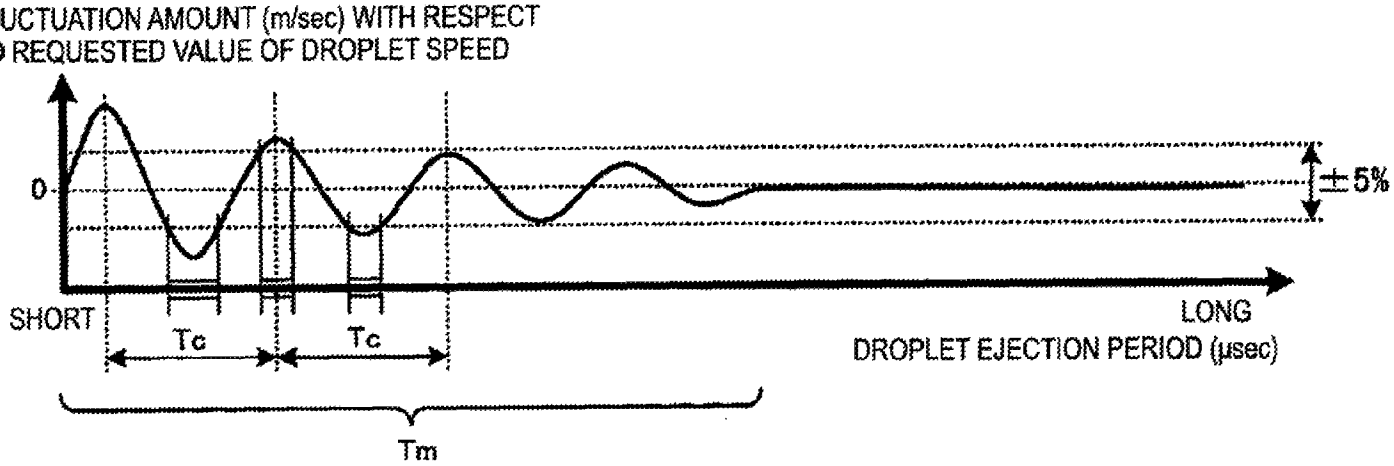

(Control Procedure 1) When a droplet ejection frequency (droplet ejection period) is determined in accordance with image formation speed, determination is made as to whether residual pressure vibration is less than ±5% or not, based on FIG. 5A or FIG. 5B.

Figure 6A:
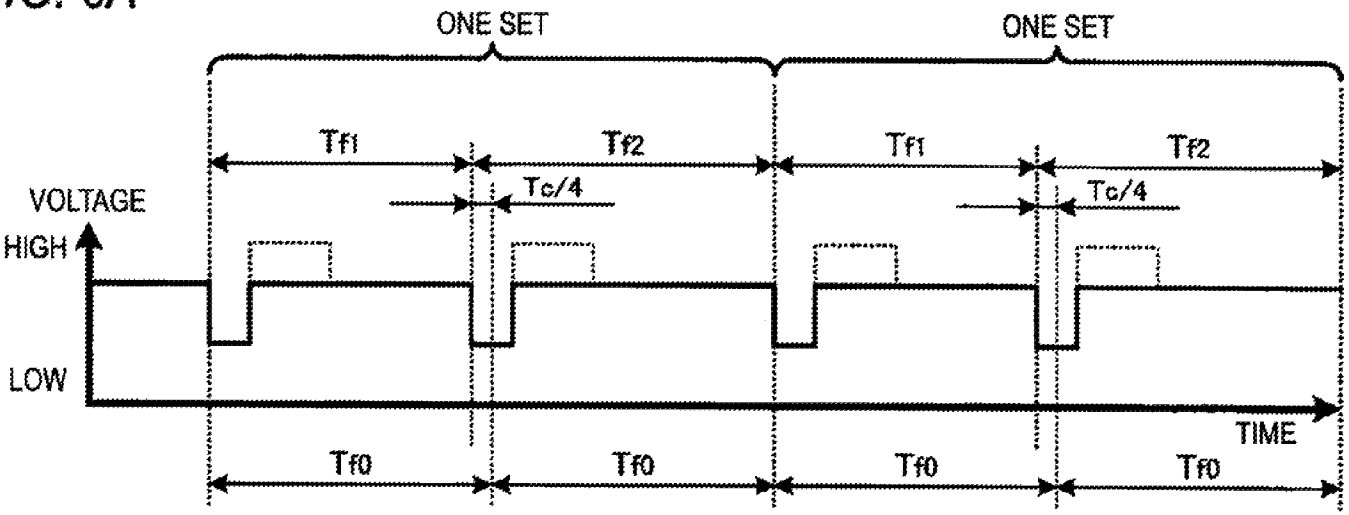
FIGS. 6A and 6B are timing charts of driving waveforms for ejecting droplets according to the exemplary embodiment and a comparative example respectively.

(Control Procedure 2) When the residual pressure vibration is in a range of not less than ±5%, a period Tf1 and a period Tf2 are generated as shown in FIG. 6A. The period Tf1 is shorter by Tc/4 than a designated droplet ejection period Tf0. The period Tf2 is longer Tc/4 than the designated droplet ejection period Tf0. Incidentally, Tc is a period of the residual pressure vibration in FIG. 5B so as to be consistent with Tf0.

(Control Procedure 3) The periods Tf1 and Tf2 generated thus are repeated as one set.

As a result, the periods Tf1 and Tf2 are shifted from the designated period Tc by ±Tc/4 respectively. Accordingly, the residual pressure vibration is secured to be less than ±5%, and the designated period Tf0 is secured in the entire period.

Figure 4:
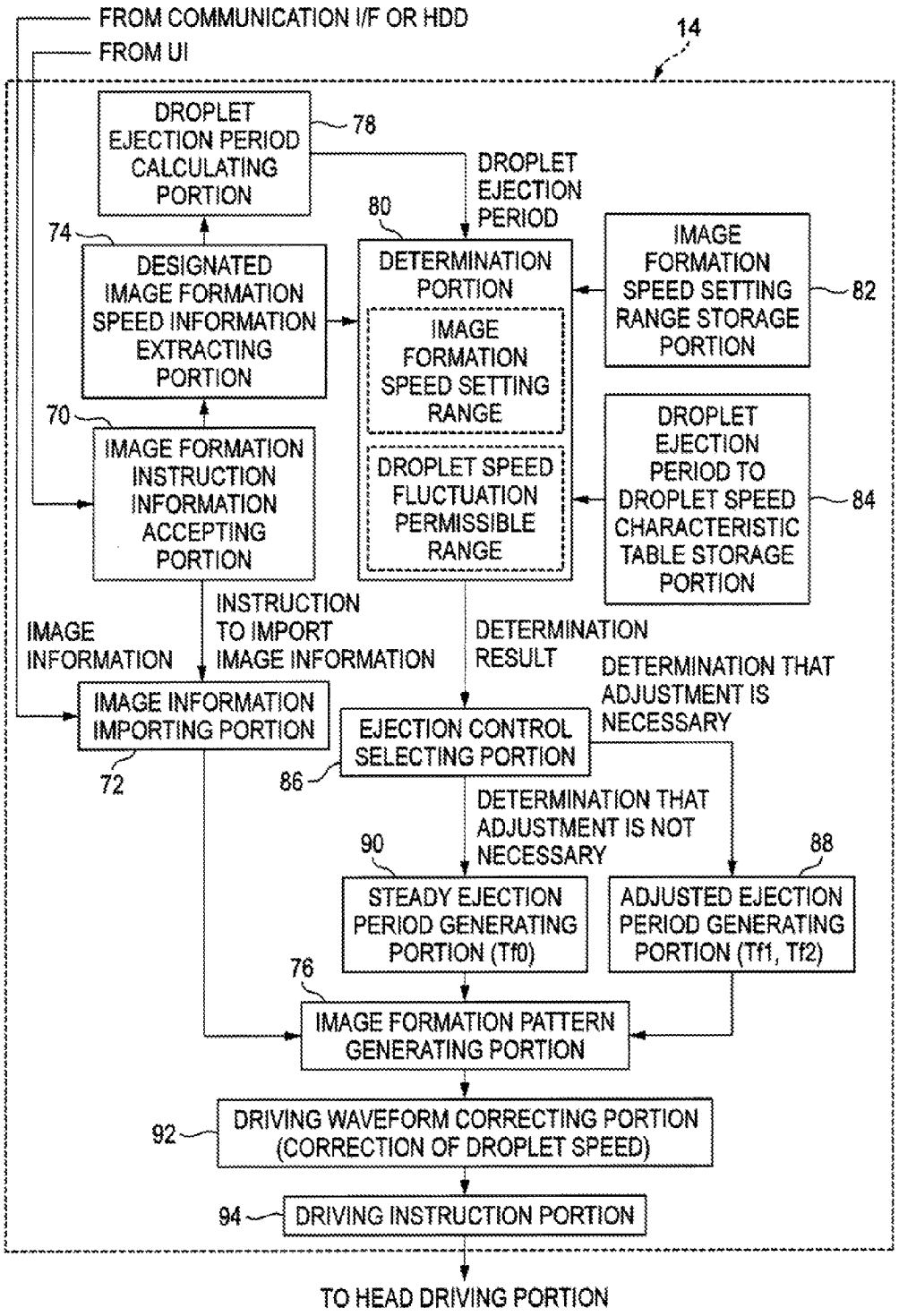
FIG. 4 is a functional block diagram showing blocked parts of period adjustment control in the control portion according to the exemplary embodiment.

FIG. 4 is a functional block diagram showing blocked parts of period adjustment control in the control portion 14 for suppressing fluctuation in the droplet speed or the droplet amount in control concerned with ejection control of a droplet from each droplet ejecting member 30. Incidentally, the respective blocked parts of the functional block diagram of FIG. 4 do not limit the hardware configuration of the control portion 14.

An image formation instruction is accepted from the UI62 (see FIG. 3) by an image formation instruction information accepting portion 70. The image formation instruction information accepting portion 70 is connected to an image information importing portion 72 and a designated image formation speed information extracting portion 74.

The image information importing portion 72 imports image information from the communication I/F 66 or the HDD 64 (see FIG. 3) based on an image information importing instruction received from the image formation instruction information accepting portion 70, and sends the imported image information to an image formation pattern generating portion 76.

On the other hand, designated image formation speed (paper feeding speed and/or resolution) is extracted from the image formation instruction information by the designated image formation speed information extracting portion 74. The extracted image formation speed is sent to a droplet ejection period calculating portion 78 and a determination portion 80.

By the droplet election period calculating portion 78, a droplet period (droplet ejection period) is calculated based on the image formation speed accepted from the designated image formation speed information extracting portion 74, and sent to the determination portion 80. Incidentally, although the calculation result may be a droplet ejection frequency (a reciprocal number of the period), it is assumed here that the period is calculated in conformity with FIG. 5B.

An image formation speed setting range storage portion 82 and a droplet ejection period to droplet speed characteristic data table storage portion 84 are connected to the determination portion 80. Determination about the following two conditions is made by the determination portion 80.

(Determination 1) Determination is made as to whether the designated image formation speed is within a setting range or not (particularly exceeds a maximum speed Vmax as an upper limit or not)

(Determination 2) Determination is made as to whether fluctuation in droplet speed is within a permissible range or not (for example, ±5% shown in FIGS. 5A and 5B or not). Incidentally, the determination 2 may be made when the designated image formation speed exceeds the setting range in the determination 1.

The determination result made by the determination portion 80 is sent to an ejection control selecting portion 86. When the designated image formation speed exceeds the setting range in the determination 1 and the fluctuation in droplet speed exceeds the permissible range in the determination 2 (determination that adjustment is necessary), the ejection control selecting portion 86 issues an instruction to an adjusted election period generating portion 88 to generate droplet ejection periods (Tf1, Tf2). The adjusted ejection period generating portion 88 serves as an example of an adjustment unit.

On the other hand, when the designated image formation speed does not exceed the setting range in the determination 1, or when the designated image formation speed exceeds the setting range in the determination 1 but the fluctuation in droplet speed does not exceed the permissible range in the determination 2 (determination that adjustment is not necessary), the ejection control selecting portion 86 issues an instruction to a steady ejection period generating portion 90 to generate a droplet ejection period (Tf0).

The adjusted ejection period generating portion 88 executes adjustment to suppress the fluctuation in droplet speed caused by residual pressure vibration in order to make the droplet speed consistent with the steady ejection period Tf0. More specifically, the adjusted ejection period generating portion 88 generates the period Tf1 and the period Tf2, as shown in FIG. 6A. The period Tf1 is shorter by Tc/4 (see FIG. 6A) than the steady ejection period Tf0. The period Tf2 is longer by Tc/4 (see FIG. 6A) than the steady ejection period Tf0. The two periods Tf1 and Tf2 are used as one set and repeated in units of one set of the periods. Thus, deviations of the two periods Tf1 and Tf2 can be cancelled with each other so that the period as a whole can correspond to the original designated period Tf0. Incidentally, Tc is a period of the fluctuation in droplet speed, which is the same as the period Tf0 (see FIG. 5B).

Figure 6B:
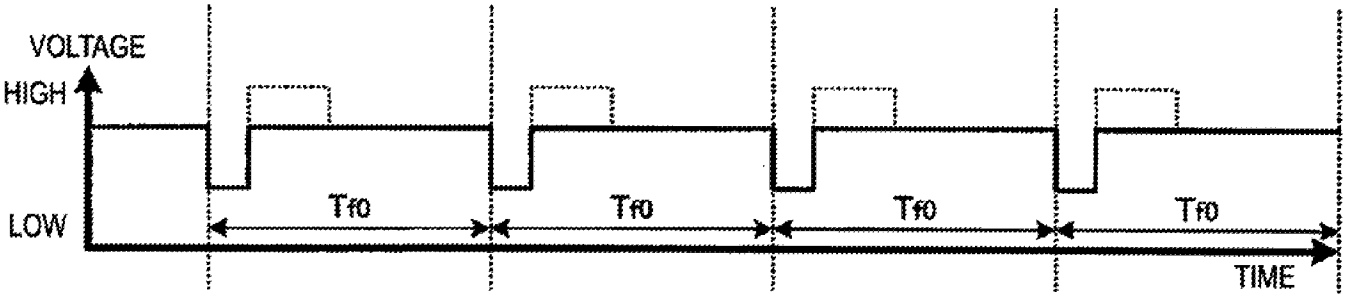

Incidentally, vibration caused by droplet ejection in each dotted line portion is reduced in driving waveforms in FIGS. 6A and 6B. Although a pulse of the dotted line portion for reducing the vibration is not shown in FIG. 8 and FIGS. 9A to 9D which will be described later, it is preferable that practical driving waveforms are used as driving waveforms including the pulses of the dotted line portions.

The adjusted ejection period generating portion 88 and the steady ejection period generating portion 90 are connected to the image formation pattern generating portion 76 respectively.

The image information is imported from the image information importing portion 72 to the image formation pattern generating portion 76 which generates an image formation pattern based on the image information and the ejection period or periods. The image formation pattern generated by the image formation pattern generating portion 76 is sent to a driving waveform correcting portion 92.

Figure 8:
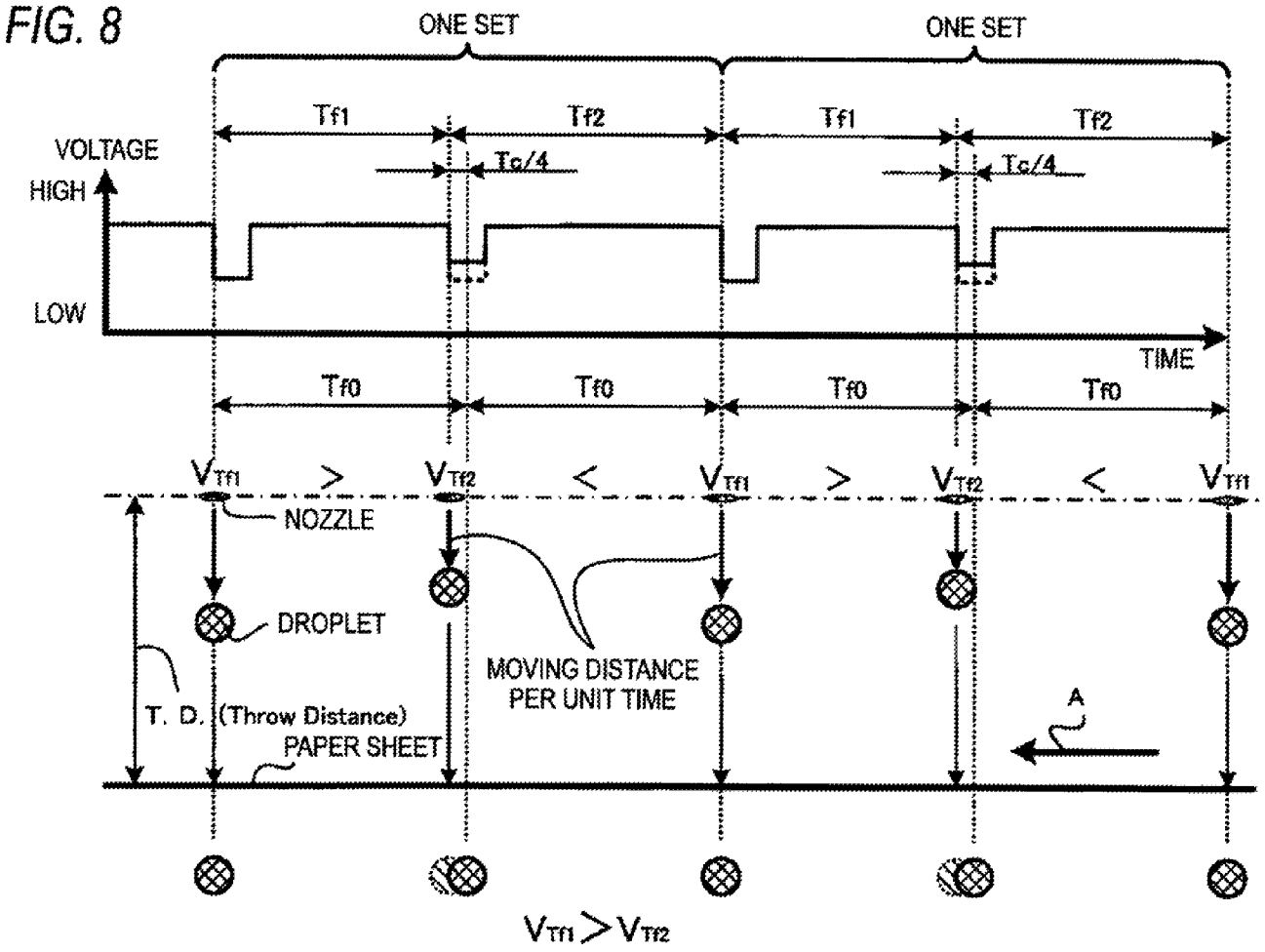
FIG. 8 is a timing chart showing details of correction of a driving waveform in a step 124 of FIG. 7.

The driving waveform correcting portion 92 executes correction of landing position of droplets on a paper sheet P. The correction is an event occurring when ejection timings have been adjusted by the adjusted ejection periods. More specifically, as shown in FIG. 8, a driving waveform is corrected to change the speed of each droplet ejected from each nozzle 32 (see FIG. 2B).

The driving waveform correcting portion 92 is connected to a driving instruction portion 94. The driving instruction portion 94 sends a driving signal to the head driving portion 22 (see FIG. 1) based on the image formation pattern in which the droplet speed has been corrected by the driving waveform correcting portion 92 if necessary.

An effect of the exemplary embodiment will be described below.

Figure 7:
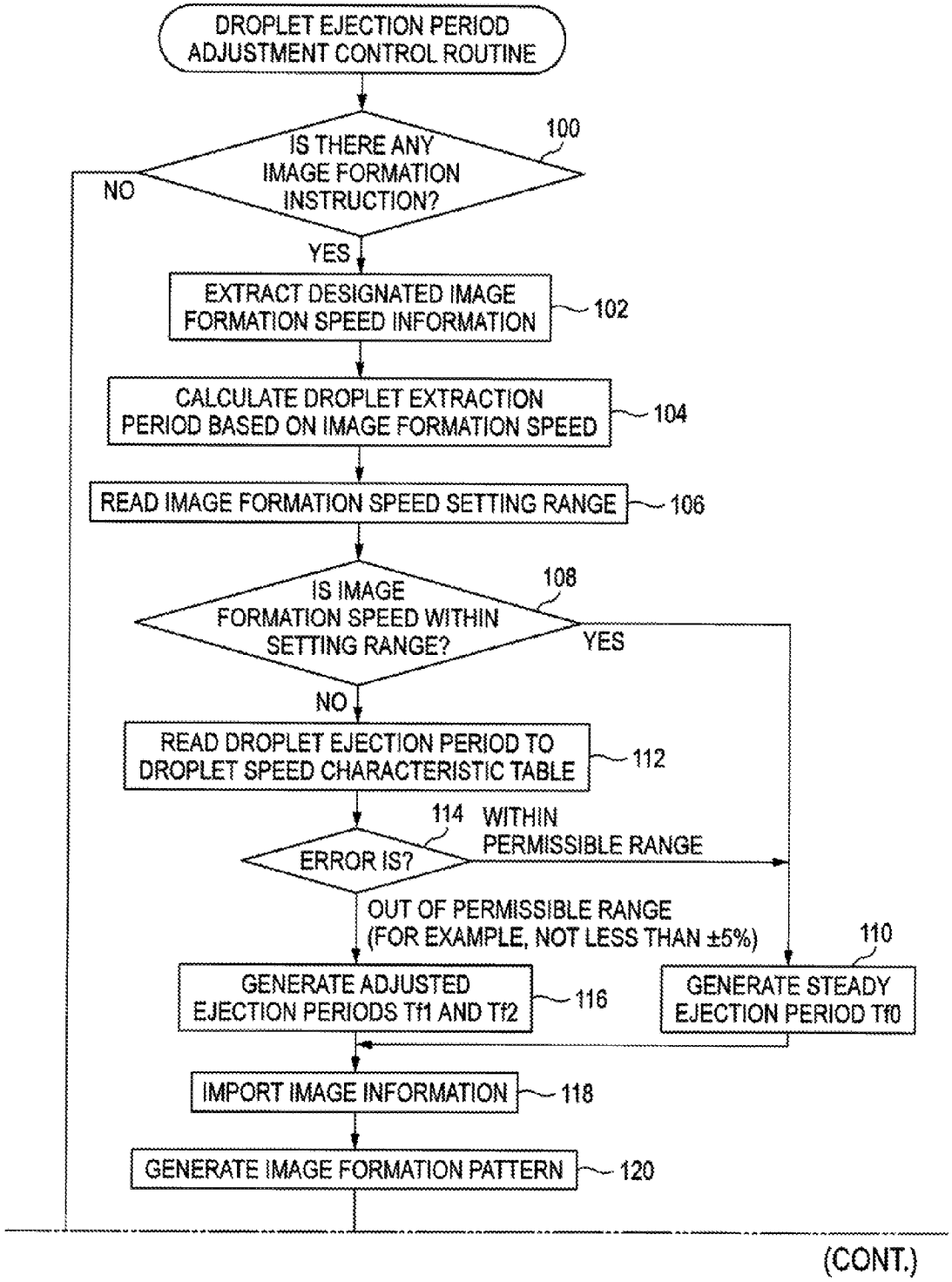
FIG. 7 is a flow chart showing the flow of a droplet ejection period adjustment control routine according to the exemplary embodiment.

FIG. 7 is a flow chart showing the flow of a droplet ejection period adjustment control routine.

FIG. 7 is the flow chart showing the flow of the period adjustment control routine performed by the control portion 14 for suppressing fluctuation in droplet speed or droplet amount in control concerned with control of ejection of a droplet from each droplet ejecting member 30.

Determination is made in a step 100 as to whether there is an image formation instruction or not. When the determination results in NO, the routine is terminated. On the other hand, when the determination results in YES in the step 100, the routine goes to a step 102 in which designated image formation speed information is extracted. Then, the routine goes to a step 104.

In the step 104, a droplet ejection period is calculated based on the image formation speed. Next, in a step 106, image formation speed setting range information (table) is read from the image formation speed setting range storage portion 82. Then, the routine goes to a step 108 in which determination is made as to whether the image formation speed is within a setting range or not.

When the determination results in YES in the step 108, the routine goes to a step 110.

On the other hand, when the determination results in NO in the step 108, conclusion is made that the image formation speed is out of the setting range. Then, the routine goes to a step 112 in which a "droplet ejection period to droplet speed" characteristic table is read from the "droplet ejection period to droplet speed" characteristic table storage portion 84. Then, the routine goes to a step 114.

In the step 114, an error of droplet speed in the droplet ejection period determined based on the image formation speed is determined.

That is, when determination is made in the step 114 that the error is within a permissible range, the routine goes to the step 110. On the other hand, when determination is made in the step 114 that the error is out of a permissible range (fox example, not less than ±5%), the routine goes to a step 116.

In the step 110, a steady ejection period Tf0 is generated, and the routine then goes to a step 118. In the step 116, adjusted ejection periods Tf1 and Tf2 are generated, and the routine then goes to the step 118.

In the step 118, image information is imported by the image information importing portion 72. Next, the routine goes to a step 120 in which an image formation pattern is generated. Then, the routine goes to a step 122.

In the step 122, determination is made as to whether it is necessary to correct a driving waveform or not. That is, when the steady ejection period Tf0 is generated, it is not necessary to perform the correction. On the other hand, when the adjusted ejection periods Tf1 and Tf2 are generated, it is necessary to correct the driving waveform by changing droplet speed correspondingly to deviations of the ejection timings.

Therefore, when determination is made in the step 122 that it is necessary to perform the correction (the adjusted ejection periods Tf1 and Tf2 are generated), the routine goes to a step 124 in which the correction of the driving waveform (correction of the droplet speed) is executed (see FIG. 8 and details will be given later). Then, the routine goes to a step 126.

On the other hand, when determination is made in the step 122 that it is not necessary to perform the correction (the steady ejection period Tf0 is generated), the routine goes to the step 126 without executing the correction.

In the step 126, a driving signal is outputted to the head driving portion 22 (22A, 22B). Then, the routine is terminated. In the head driving portion 22 (22A, 22B), the respective heads 24 are controlled based on the inputted driving signal to execute image formation.

The correction of the driving waveform in the step 124 of FIG. 7 will be described here in detail.

When the adjusted ejection periods Tf1 and Tf2 are generated for ejecting droplets as shown in FIG. 8, every second droplet is ejected at earlier timing by a period (Tc/4)×2. When every second droplet is ejected at earlier timing by the period (Tc/4)×2, each droplet ejected at the period Tf2 can reach the paper sheet P earlier than each droplet ejected at the period Tf1, as designated by dotted line positions in FIG. 8. The paper sheet P is fed in a direction of an arrow A in FIG. 8.

In this case, unstable fluctuation in ejection timing among droplets can be avoided due to the ejection timing control based on the period adjustment. However, for example, in accordance with some threshold for determining whether the image quality is good or poor, the image quality may be determined to be poor.

Therefore, correction is performed in such a manner that an ejection speed VTf2 of the period Tf2 whose ejection timing is earlier by the period (Tc/4)×2 with respect to the period Tf1 is made slower than an ejection speed VTf1 of the period Tf1. The speed correction is set based on a distance (T.D. "Throw Distance") between the nozzle and the paper sheet.

Due to the correction, the droplets ejected at the period Tf2 are displaced to solid line positions from the dotted line positions in FIG. 8 on the paper sheet P so that an interval between adjacent ones of the droplets can be constant.

Incidentally, the invention is not limited to the case where one of the ejection speeds is adjusted to the other ejection speed. To describe in an extreme manner, the two speeds may be corrected so that the sum of added values of correction ratios can reach 100%.

For example, with an intermediate point as a reference, ejection speed VTf1 of the period Tf1 may be made slower by 50% (period Tc/4) of an amount to be corrected and ejection speed VTf2 of the period Tf2 may be made faster by 50% (period Tc/4) of the amount to be corrected.

(Modifications)

In FIGS. 9A to 9D, driving waveforms for performing continuous ejection driving are used as modifications of the droplet ejection driving waveform, for example, in order to land "large droplets" and "small droplets".

The continuous ejection driving means driving by which a plurality of droplets can be landed in one and the same position (strictly the positions which can be regarded as one and the same dot though not concentric because the paper sheet P is being fed).

For example, a single driving waveform is prepared (stored) as the driving waveform in advance. Respective pulses can be set ON/OFF independently by the head driving portion 22A, 22B (see FIG. 1) side.

When a "large droplet" is formed, both pulses are set ON so that droplets can be ejected in the two pulses respectively (continuous ejection driving).

When a "small droplet" is formed, one (front) pulse is set OFF and the other (rear) pulse is set ON so that a droplet can be ejected in the other (rear) pulse.

The modifications show that period adjustment according to the exemplary embodiment and speed correction can be performed even in the continuous ejection driving waveforms.

Figure 9A:
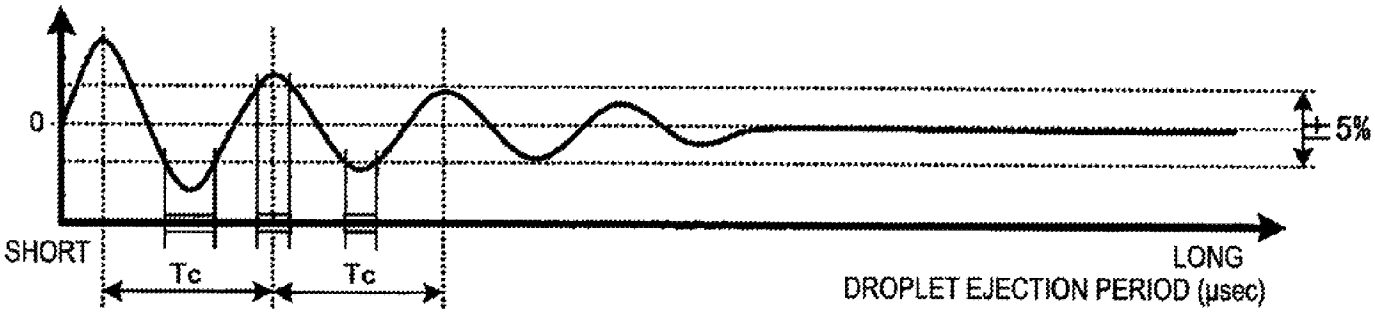
FIGS. 9A, 9B, 9C and 9D are a droplet election period to liquid speed fluctuation amount characteristic graph according to a modification, a timing chart of a driving waveform for ejecting droplets according to a comparative example, a timing chart of a driving waveform for ejecting droplets according to a modification (continuous ejection pattern 1), and a timing chart of a driving waveform for ejecting droplets according to a modification (continuous ejection pattern 2) respectively.
Figure 9B:
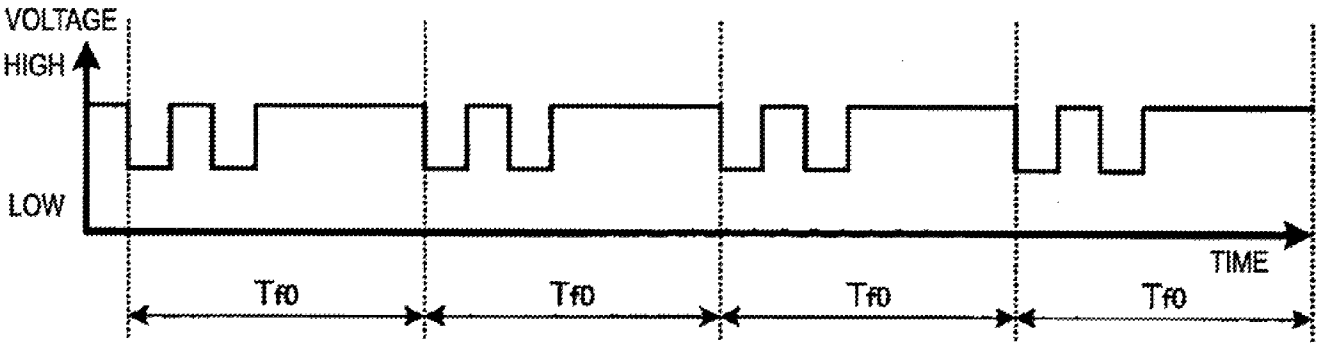

FIG. 9A is the same period characteristic graph as the period characteristic graph showing the influence of pressure vibration in FIG. 5B. FIG. 9B is an output timing chart of a continuous ejection driving waveform as a comparative example, when period adjustment and speed correction are not executed on the driving waveform.

In the comparative example of FIG. 9B, the driving waveform is affected by pressure vibration in the same manner as the driving waveform (single pulse) in the exemplary embodiment, and further, continuous ejection timings may fluctuate irregularly relatively to one another to thereby accelerate lowering of the image quality in the case of the continuous ejection driving.

Figure 9C:
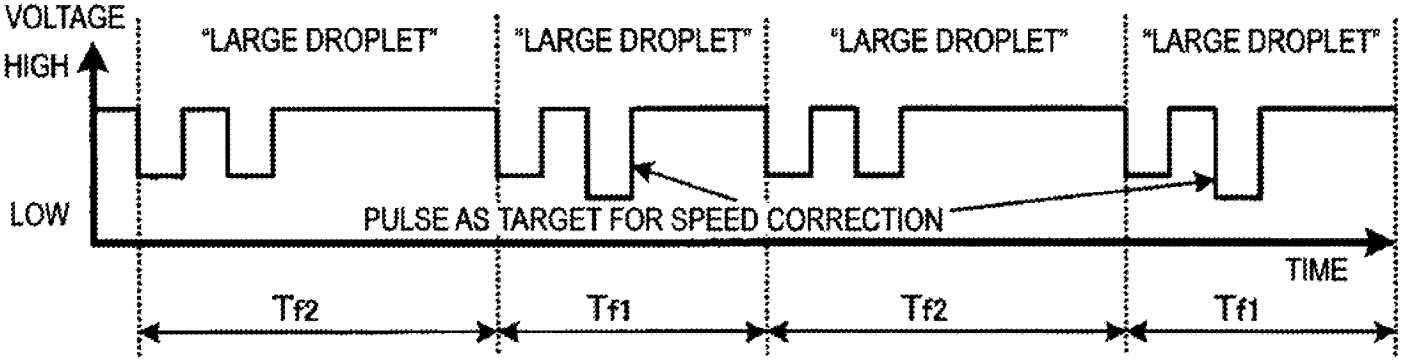
Figure 9D:
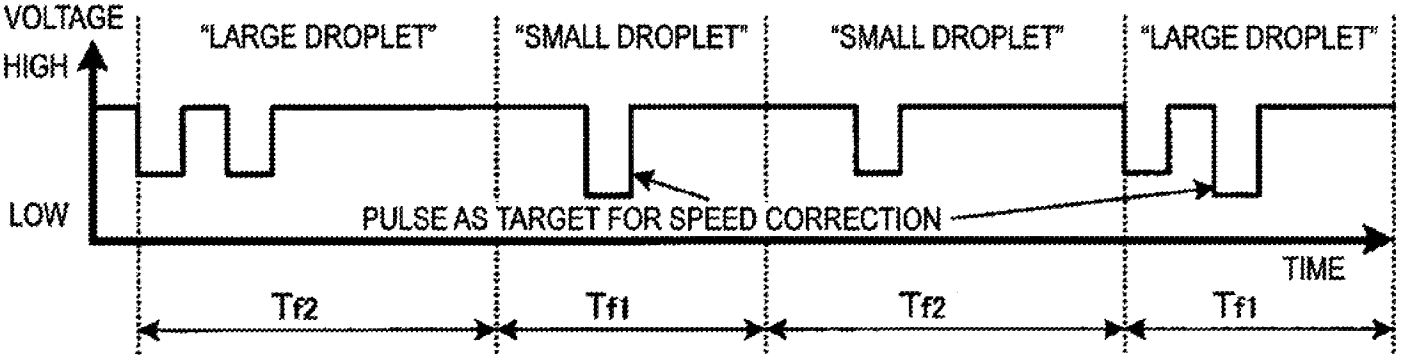

FIGS. 9C and 9D are output timing charts of continuous ejection driving waveforms of patterns having different combinations of "large droplets" and "small droplets".

FIG. 9C is a continuous ejection pattern of a "large droplet"→a "large droplet"→a "large droplet"→a "large droplet", to which both front and rear pulses are applied. In addition, the amplitude of the rear pulse in each driving waveform is corrected for speed correction in FIG. 9C.

In addition, FIG. 9D is a continuous election pattern of a "large droplet"→a "small droplet"→a "small droplet"→a "large droplet", to which only rear pulses are applied to the "small droplets". In addition, the rear pulse of each driving waveform is inevitably selected and the amplitude of the selected rear pulse is corrected for speed correction in FIG. 9D.

In other words, in any continuous ejection pattern in which "large droplets" and "small droplets" are mixed, including FIG. 9C and FIG. 9D, the same pulse (rear pulses) are selected so that speed correction can be made.

Incidentally, although the exemplary embodiment (including the modifications) has a configuration in which two periods are used as one set to maintain a requested period every two periods, three periods or more may be used as one set for generating a driving waveform.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A droplet driving control device comprising:

a droplet ejection control unit which ejects droplets at requested droplet ejection periods; and an adjustment unit which adjusts control of the droplet ejection control unit using at least continuous two of the droplet ejection periods as one set based on an error of droplet speed with respect to a proper value thereof, so that droplets can be ejected at different droplet ejection periods within a range of the one set, and an average value of the droplet ejection periods within the range of the one set for ejecting the droplets can be equal to each of the requested droplet ejection periods.

2. The droplet driving control device according to claim 1, wherein the adjustment unit increases/decreases droplet ejection timings in the range of the one set by values to thereby cancel the values with each other so that droplet speed of each droplet can approach a set value of the droplet speed in each of the periods within the range of the one set.

3. The droplet driving control device according to claim 2, wherein:

the error in the droplet speed is caused by a characteristic of residual vibration whose amplitude increases around the proper value of the droplet speed as each of the droplet ejection periods is shorter, and converges keeping a specific frequency; and the adjustment unit executes the adjustment when there is at least a predetermined error in the droplet speed in the requested droplet ejection periods.

4. The droplet driving control device according to claim 3, wherein timings expressed by Tf1=Tf0−(Tc/4) and Tf2=Tf0+(Tc/4) are set as the droplet ejection timings when the periods in the range of the one set include two periods, i.e. a first period and a second period, which have a temporal relation sequential to each other, the droplet ejection period as a reference is Tf0, the first period is Tf1, the second period is Tf2 and a period of the residual vibration characteristic is Tc.

5. The droplet driving control device according to claim 4, further comprising a correction unit which corrects the droplet speed after the droplet ejection period has been adjusted by the adjustment unit.

6. The droplet driving control device according to claim 5, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

7. The droplet driving control device according to claim 2, further comprising a correction unit which corrects the droplet speed after the droplet ejection period has been adjusted by the adjustment unit.

8. The droplet driving control device according to claim 7, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

9. The droplet driving control device according to claim 3, further comprising a correction unit which corrects the droplet speed after the droplet ejection period has been adjusted by the adjustment unit.

10. The droplet driving control device according to claim 9, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

11. The droplet driving control device according to claim 1, wherein:

the error in the droplet speed is caused by a characteristic of residual vibration whose amplitude increases around the proper value of the droplet speed as each of the droplet ejection periods is shorter, and converges keeping a specific frequency; and the adjustment unit executes the adjustment when there is at least a predetermined error in the droplet speed in the requested droplet ejection periods.

12. The droplet driving control device according to claim 11, wherein timings expressed by Tf1=Tf0−(Tc/4) and Tf2=Tf0+(Tc/4) are set as the droplet ejection timings when the periods in the range of the one set include two periods, i.e. a first period and a second period, which have a temporal relation sequential to each other, the droplet ejection period as a reference is Tf0, the first period is Tf1, the second period is Tf2 and a period of the residual vibration characteristic is Tc.

13. The droplet driving control device according to claim 12, further comprising a correction unit which corrects the droplet speed after the droplet ejection period has been adjusted by the adjustment unit.

14. The droplet driving control device according to claim 13, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

15. The droplet driving control device according to claim 11, further comprising a correction unit which corrects the droplet speed after the droplet ejection period has been adjusted by the adjustment unit.

16. The droplet driving control device according to claim 15, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

17. The droplet driving control device according to claim 1, further comprising a correction unit which corrects the droplet speed after the droplet ejection period has been adjusted by the adjustment unit.

18. The droplet driving control device according to claim 17, wherein:

the correction unit deforms a predetermined driving waveform when each droplet reserved in a pressure chamber is ejected from a nozzle under pressure control using the driving waveform; and the correction unit deforms the driving waveform into a driving waveform decreasing pressure when the droplet ejection timing is earlier, and deforms the driving waveform into a driving waveform increasing pressure when the droplet ejection time is later.

19. An image forming apparatus, comprising:

the droplet driving control device according to claim 1, wherein the image forming apparatus can select one from a normal specification mode and a specific specification mode as a droplet ejection period, an image being formed in a setting range in which at least droplet speed does not fluctuate in the normal specification mode, an image being formed in a specific period which exceeds the setting range in the specific specification mode.

* * * * *